United States Patent [19]

Jartoux et al.

[11] Patent Number: 4,586,303

[45] Date of Patent: May 6, 1986

[54] PROCESSES AND DEVICES FOR PRESTRESSING CONCRETE WORKS AND TO THE CORRESPONDING WORKS

[75] Inventors: Pierre Jartoux, Epernon; Christian Brondeau, Lesigny, both of France

[73] Assignee: Freyssinet International, Boulogne Billancourt, France

[21] Appl. No.: 615,265

[22] Filed: May 30, 1984

[30] Foreign Application Priority Data

Jun. 3, 1983 [FR] France ..... 83 09278

[51] Int. Cl.[4] ..... E04C 3/10

[52] U.S. Cl. ..... 52/309.16; 52/226

[58] Field of Search ..... 52/223 R, 223 L, 230, 52/225, 226, 309.16

[56] References Cited

U.S. PATENT DOCUMENTS 3,412,511 11/1968 Dietrich ..... 52/612
3,843,288 10/1974 Howlett et al. ..... 52/223 L
3,937,607 2/1976 Rodormer ..... 52/223 L
4,473,915 10/1984 Finsterwalder ..... 52/226

FOREIGN PATENT DOCUMENTS 642128 6/1926 Canada ..... 52/174
541437 11/1941 United Kingdom ..... 52/230

*Primary Examiner*—James L. Ridgill, Jr.
*Attorney, Agent, or Firm*—Larson and Taylor

[57] ABSTRACT

The invention relates to a concrete work prestressed by means of tensioned reinforcements (7) having bell shaped ends ($7_1$) and formed from an alternate succession of first sections housed, with interposition of an injected cement, in metal sheaths (9) themselves embedded in the concrete and rectilinear sections outside the concrete. For easy replacement of these reinforcements, the first sections have a rectilinear or curved shape of an arc of a circle and they are housed in plastic material tubes (10) adapted to slide against the metal, the tube ends situated at the level of the bell mouthed reinforcement ends ($7_1$) being themselves given the shape of open mouthed sleeves (11) made from plastic material.

4 Claims, 4 Drawing Figures

Figure 1:
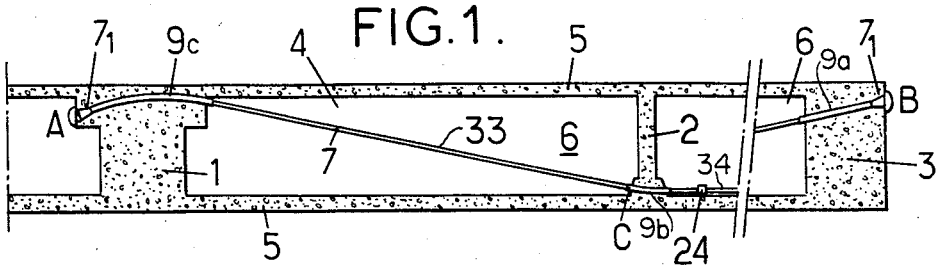

PROCESSES AND DEVICES FOR PRESTRESSING CONCRETE WORKS AND TO THE CORRESPONDING WORKS

The invention relates to processes and devices for subjecting concrete works to prestressing by means of reinforcements tensioned and contained, at least partially, in sheaths themselves embedded in these works.

It relates more particularly to the case:

where the reinforcements in question are formed by bundles of wires or strands housed in their sheaths with intimate filling, more particularly with special injected cement, the anchorage of the wires or strands of such a bundle at each of its ends resulting in this end widening out in a truncated cone shape, and where the works considered have cavities, that is to say formed by concrete blocks bearing against each other, in the direction of application of the prestress, through bracer elements generally integral with these blocks and forming cavities therebetween, the reinforcements then passing successively through said blocks and said cavities and having in these cavities sections in the open air, that is to say external to the concrete.

For rejuvenating such works or reinforcing them at least temporarily, it may be desirable to replace some at least of their prestressed reinforcements by new reinforcements.

This is in particular the case when these reinforcements have undergone local damage and/or when it is desired to give to the works considered new missions leading to higher stresses, such for example as the reinforcement of a bridge intended to support at least temporary overloads or when a building is heightened.

With the embodiments generally adopted for the sheaths and reinforcements considered, such a replacement is not possible.

The aim of the invention is especially to make such replacements possible.

To this end, the concrete works prestressed in accordance with the invention are essentially characterized in that the mean lines of the sections of their prestress reinforcements which are housed in concrete masses are all rectilinear or in the form of an arc of a circle and in that, at least along the whole of said sections, each of said reinforcements is housed, with its filling material, in a plastic material tube adapted to slide against the metal, the two ends of this tube being preferably connected to two bell mouthed plastic material sleeves surrounding respectively the two corresponding reinforcement ends, which sleeves are dimensioned and disposed so that, with respect to the members anchoring the reinforcement, they may be disengaged axially through these members.

For constructing a concrete work equipped with prestressed reinforcements in accordance with the preceding paragraph, the metal sheath sections intended to receive the reinforcements and to be bedded in the concrete are placed in shuttering before the concrete is poured, this placing being carried out so that the mean line of each of these sections extends along a straight or curved arc of a circle and so that the consecutive ends of these different mean lines are aligned in pairs, then each plastic material tube, provided possibly with its reinforcement beforehand, is fitted successively in the different sheath sections which correspond thereto, before or after the concrete is poured about these sheath sections.

As far as the ends of the reinforcements are concerned, the procedure to be adopted is advantageously as follows: each sheath end section is interrupted, on the side of the corresponding reinforcement end, a little short of this end and, before the concrete is poured, on the one hand the anchorage member intended to serve as support for said reinforcement end and, on the other hand, a truncated cone shaped connection adapted to establish at least temporarily the continuity between the interrupted end of the sheath and said anchorage member are positioned in shuttering, after which the concrete is poured, then the connection is disengaged axially, if it is removable: thus, in all cases, there is formed inside the cast concrete mass, between the interrupted sheath end and the anchorage member, a truncated cone shaped housing adapted to receive one of the above bell mouthed sleeves.

In special embodiments, recourse is further had to one and/or other of the following arrangements:

the truncated cone shaped connection is removable and formed by a plug defined at least laterally by an annular wall made from rubber or similar material adapted to be distended radially by axial compression thereof and thus to provide a sealing connection between the two annular seals to be joined together, the annular wall according to the preceding paragraph is mounted jointingly about a rigid tubular mandrel axially shorter than it and axial compression thereof is provided by screwing an outer nut on a threaded tiebolt passing axially through two transverse end plates which bear respectively on the two ends of said wall, one of the transverse plates according to the preceding paragraph further bears axially on the outer face of the anchorage member.

For removing a reinforcement improved in the above described way for replacement thereof, this reinforcement is cut in one at least of its zones exposed outside the concrete so as to be able to withdraw axially the whole of the reinforcement sections thus cut which remain housed in the concrete, then these different axial removals are carried out, the end sections being removed with their bell mouthed ends first.

The invention comprises, apart from these main arrangements, certain other arrangements which are used preferably at the same time and which will be more explicitly discussed hereafter.

In the following, a preferred embodiment of the invention will be described with reference to the drawings in a way which is of course in no wise limiting.

Figure 2:
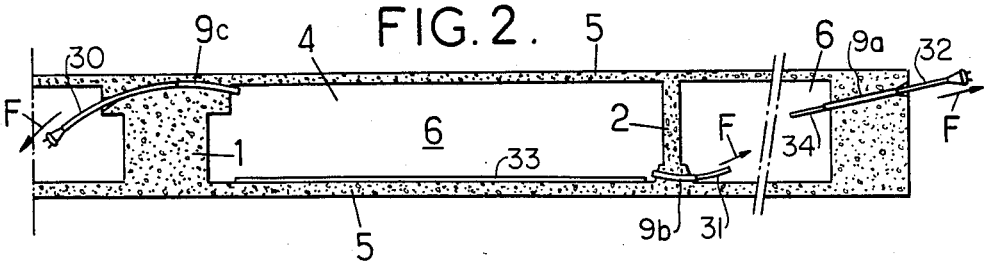
Figure 4:
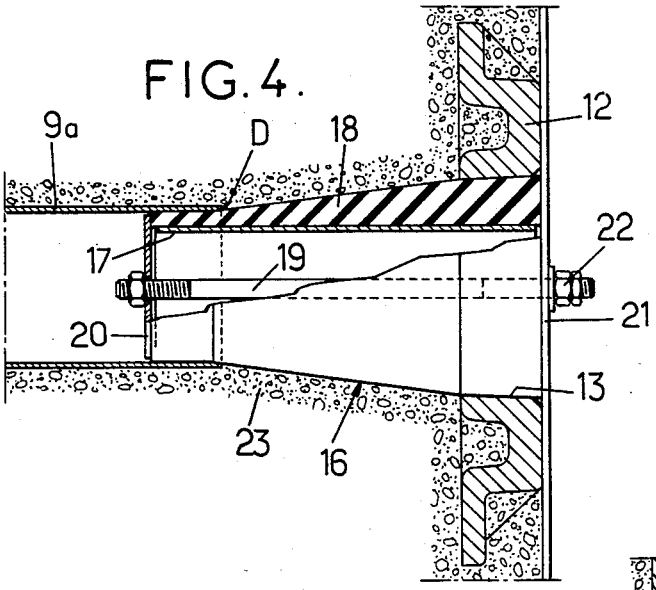
Figure 3:
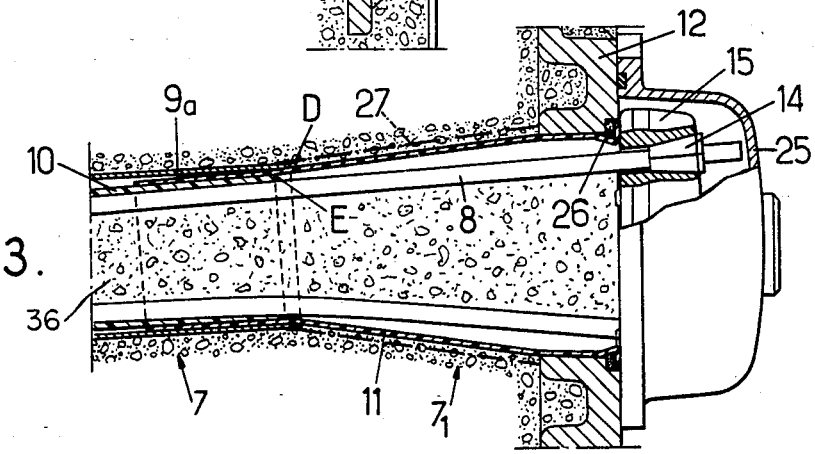

FIG. 1, of these drawings, shows in longitudinal vertical section a concrete bridge span with cavities equipped with a prestress reinforcement in accordance with the invention, FIG. 2 shows similarly the same span during dismantling of said reinforcement, FIG. 3 shows in axial section one end of such a reinforcement positioned and tensioned at one end of the concrete span, and FIG. 4 shows in an axial section similar to that of FIG. 3 one of the phases of manufacturing said reinforcement end.

The concrete work which it is desired to subject, in accordance with the invention, to "interchangeable prestressing" is formed with cavities, that is to say composed of concrete masses or blocks 1, 2, 3 bearing against each other through bracing slabs or webs 4, 5, which forms cavities 6 between the blocks.

In the embodiment illustrated in FIGS. 1 and 2, the work in question is a bridge span constructed in any desirable way, for example cast on site or beforehand or else prefabricated from elements.

To subject this span to prestressing, reinforcements 7 are provided in a way known per se formed from multiple wires or strands 8 (FIG. 3) tensioned between their ends A and B at the level of anchorage members each bearing against one of blocks 1, 2, 3.

Each reinforcement comprises an alternate succession of first sections 30, 31, and 32 passing through blocks 1, 2, 3 in metal sheaths *9a*, *9b*, and *9c* themselves embedded in these blocks, and second rectilinar sections 33 and 33 external to the concrete, extending between said blocks.

But whereas, in known constructions, some at least of the main lines of the first reinforcement sections had curvatures varaible along these sections, - which made the axial movement of these sections impossible after mounting - said mean lines, according to a first feature of the invention, all extend along a straight or curved arc of a circle (a straight arc or straight line segment is an arc of a circle having an infinite radius) and the same goes for the metal sheaths, whose positioning shutterings, before casting the concrete, must be specially provided accordingly.

These metal sheaths *9a*, *9b*, and *9c* must be smooth, as shown in FIGS. 3 and 4.

Each end $7_1$ of reinforcement 7, when it is tensioned, takes on a bell mouthed shape in the form of a truncated cone.

After this tensioning, in known embodiments, the volumes inside the metal sheaths which are not occupied by the reinforcements were filled with an injected cement grout 36 or similar.

When it sets, this cement is adhered to the inner face of the metal sheaths *9a*, *9b*, or *9c*: this is a second reason why, after setting, it is no longer possible to remove the reinforcements axially from their sheaths.

To make such removal possible, according to a second feature of the present invention, each reinforcement is housed from one end to the other in a tube 10 made from a plastic material adapted to slide along the metal sheaths *9a*, *9b*, or *9c* the ends of this tube ending in opened out sleeves 11, (FIG. 3) at the level of the bell mouthed ends of the reinforcement.

These sleeves 11 are dimensioned and mounted so as to be able to be disengaged axially through the corresponding anchorage members 12.

They are connected sealingly, with respect to the injected cement, not only to said anchorage members by crushing an O seal 26 but also to tube 10 in which they extend, more especially by mutual jointing fitting together.

The plastic material forming tubes 10 and sleeves 11 is advantageously polyethylene but could be any other sufficiently economical plastic material, not adhering to the metal and to the concrete and capable of forming continous and sealed cases.

For fitting such a reinforcement, the following is the procedure to adopt.

Before casting the concrete, the different metal sheath sections *9a*, *9b*, and *9c* whose mean lines extend along straight (sheath *9a*) or along curved (sheaths *9b* and *9c*) arcs of a circle, are positioned in the shuttering intended to receive the concrete.

The ends C (FIG. 1) of the sheath section *9b* which does not correspond to a reinforcement end is provided so that it extends slightly beyond the corresponding concrete blocks after casting thereof.

On the contrary, the ends D (FIGS. 3 and 4) of said sheath sections *9a* and *9c*, corresponding to the reinforcement ends, are interrupted a little short of the corresponding orifices of the concrete blocks to be manufactured.

Then the corresponding anchorage members 12 are positioned, which are formed more especially by cast iron or steel plates having a central orifice 13 therethrough.

The diameter of this orifice 13, greater than that of sheath *9a*, is determined as a function of the bell mouthed end of reinforcement $7_1$ to be received, which end comprises more especially a plurality of split truncated cone shaped jaws 14 (FIG. 3) each gripping round a wire or strand end 8 and each received in a complementary housing of an anchorage head 15 whose periphery bears against member 12.

So as to form, during casting of the concrete, a truncated cone shaped housing between orifice 13 and the interrupted end D of sheath *9a* situated proximate to this orifice, these two annular seats 13 and D may be joined together by means of a truncated cone shaped metal sheet connection shown in FIG. 3 by the dash dot lines 27, the different linear assemblies being provided sealingly to the cast concrete, particularly by continuous welding or by spot welding and covering with a retractable or adhesive flexible sealing strip.

In the variant shown in FIG. 4, so as to form the above truncated cone shaped housing, a plug 16 with an outer truncated cone shaped surface is temporarily placed between the two annular seats 13 and D.

So as to provide suitable sealing with respect to the cast concrete between this plug 16 and these two seats, at least the peripheral zone of this plug is advantageously formed from a radially distendable material.

In the embodiment illustrated in FIG. 4, this radial distention is provided by axial compression and plug 16 comprises for this purpose a rigid central tubular mandrel 17 surrounded jointingly by a sleeve 18 made of rubber or of a similar material having an outer truncated cone shaped surface, said sleeve 18 extending axially beyond the mandrel 17. Further a central tiebolt 19 extending along the axis of the mandrel 17 passes axially through two transverse end plates 20 and 21 which bear respectively on the two ends of the sleeve 18 so that the simple screwing and unscrewing of a nut 22 on the outer end of this tiebolt 19 allows said sleeve 18 to be radially distended or expanded and contracted.

For correct positioning of plug 16, the outer plate 21 advantageously bears against the anchorage member 12.

After positioning of plug 16 - and possible radial expansion thereof by screwing, if this solution is chosen - concrete 23 is cast.

Then plug 16 is released - after having contracted it radially by unscrewing according to the above assumption -.

Thus a continuous duct is obtained with bell mouthed opening adapted to receive one end of tube 10 and the corresponding end sleeve 11.

Then said tube 10 is positioned, this tube being formed of two successive pieces each extending over substantially half the total length and each ending in a sleeve 11, fitted onto its end E and bonded or welded.

To this end, each of said pieces is introduced into a discontinuous succession of ducts formed by the sheath sections 9*a* and 9*c* embedded in the concrete, with the corresponding sleeve 11 at the rear, the two successions considered being disposed in the extension of each other and concerning the whole of the sections in question.

At the end of this introduction, the front end of the two pieces are joined to one another by means of a case 24 (FIG. 1) and the two truncated cone shaped sleeves are housed in the bell mouths of the endmost ducts, without any mutual adherence between these sleeves and the facing faces of these mouths.

The wires or strands 8 forming the reinforcement are then fitted into tube 10.

Then these wires or strands are tensioned between their ends, after which the ends thus tensioned are retained by means of jaws 14.

Then the anchorage heads 15 are capped with appropriate caps 25 fixed to the anchorage members 12 in any desirable way, more especially by bolting, and liquid cement is injected into the inner volumes of tubes 10, end pieces 11 and caps 25, more especially from the case 24, appropriate vents then being provided in the caps 25.

The reinforcement is thus tensioned, protected and exerts the desired pre-stress on the concrete work.

To disengage this reinforcement, it is sufficient to shear its sections exposed outside the concrete, then to disengage its sections housed in sheaths 9*a*, 9*b*, or 9*c* axially in the direction of arrows F (FIG. 2).

Such extraction is possible because on the one hand of the general shape (rectilinear or in an arc of a circle) adopted for the sections concerned and on the other hand because of the absence of adherence between tube 10, including its end pieces 11, and the internal faces of the housing which contain it. It may even be noted that this extraction only requires relatively small forces. It is then possible to go ahead with positioning a new reinforcement in the way explained above.

Following which, whatever the embodiment adopted, means are obtained for equipping cavity concrete works with interchangeable prestressing reinforcements, the construction and use of such means following sufficiently from the foregoing.

As is evident, and as it follows moreover already from what has gone before, the invention is in no wise limited to those of its modes of application and embodiments which have been more especially considered; it embraces, on the contrary, all variants thereof, more especially those where the volume, inside tube 10, which is not occupied by the reinforcements, is not filled by a cement but by another material such as a rubber or elastomer plug having multiple passages therethrough for receiving the different wires or strands, this method being especially advantageous in the case where tube 10 in question is provided only along the sections of the reinforcement housed inside the concrete masses.

We claim:

1. A concrete work including blocks and cavities therebetween; said concrete work being prestressed by means of replaceable tensioned reinforcements (7) having bell mouthed ends ($7_1$) which anchor the reinforcements in opposed blocks, intermediate the ends the reinforcements are formed from an alternating sucession of (a) first tubular sections housed, with interpositioning of a filling material, in tubular metal sheaths (9) themselves embedded in the associated block and (b) second rectilinear sections external to the concrete in an associated cavity; characterized in that each of the first sections extend along an arc of a circle so as to be withdrawable through the surrounding metal sheath in the block and in that each reinforcement is housed, at least all along said first sections, in a plastic material tube (10) adapted to slide axially along the respective metal sheath.

2. The concrete work according to claim 1, characterized in that the ends of the tube (10) are connected to two bell mouthed sleeves (11) made from a plastic material and surrounding respectively the two corresponding ends of reinforcements ($7_1$), these bell mouthed sleeves being dimensioned and disposed so that, with respect to the members (12) for anchoring the reinforcement, they may be disengaged axially through these members.

3. The concrete work according to claim 2, characterized in that each bell mouthed sleeve (11) is assembled sealingly with respect to the injected filling material on tube (10) and the anchoring member (12) which it connects together.

4. The concrete work according to claim 2, characterized in that the plastic material forming the tubes (10) and the sleeves (11) is polyethylene.

* * * * *